US009694595B2

(12) United States Patent
Ohtsu et al.

(10) Patent No.: US 9,694,595 B2
(45) Date of Patent: Jul. 4, 2017

(54) LIQUID CIRCULATION DEVICE, LIQUID DISCHARGE DEVICE AND CONTROL METHOD FOR THE SAME

(71) Applicant: TOSHIBA TEC KABUSHIKI KAISHA, Shinagawa-ku, Tokyo (JP)

(72) Inventors: Kazuhiko Ohtsu, Shizuoka (JP); Kazuhiro Hara, Shizuoka (JP); Yasushi Kuribayashi, Shizuoka (JP); Yoshiaki Kaneko, Shizuoka (JP); Hiroyuki Ishikawa, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/088,523

(22) Filed: Apr. 1, 2016

(65) Prior Publication Data

US 2016/0288523 A1 Oct. 6, 2016

(30) Foreign Application Priority Data

Apr. 3, 2015 (JP) ..... 2015-076789

(51) Int. Cl.

| | |
|---|---|
| ***B41J 2/175*** | (2006.01) |
| ***B41J 2/17*** | (2006.01) |
| ***B41J 29/38*** | (2006.01) |
| ***B41J 2/18*** | (2006.01) |
| ***B41J 2/14*** | (2006.01) |

(52) U.S. Cl.

CPC ..... *B41J 2/18* (2013.01); *B41J 2/14233* (2013.01); *B41J 2/175* (2013.01); *B41J 2/1707* (2013.01); *B41J 2/17566* (2013.01); *B41J 29/38* (2013.01); *B41J 2202/12* (2013.01)

(58) Field of Classification Search

CPC ..... B41J 2/18

See application file for complete search history.

(56) References Cited

U.S. PATENT DOCUMENTS

2011/0050794 A1* 3/2011 Koike ..... B41J 2/175 347/22
2011/0053253 A1* 3/2011 Kim ..... C12N 9/0006 435/252.33

(Continued)

FOREIGN PATENT DOCUMENTS

BE EP 1932671 A1 * 6/2008 ..... B41J 2/175
JP 2011-189701 9/2011

*Primary Examiner* — Shelby Fidler

(74) *Attorney, Agent, or Firm* — Amin, Turocy & Watson LLP

(57) ABSTRACT

A liquid circulation device comprises a liquid chamber connected with a liquid discharge section that discharges liquid and able to hold the liquid; a circulation section configured to circulate the liquid in a flow path containing the liquid chamber and the liquid discharge section; a liquid replenishment section configured to replenish the liquid to the liquid chamber; a gas control section configured to be able to pressurize or decompress the liquid chamber; and a control section configured to replenish the liquid through the liquid replenishment section in a case in which pressure of the liquid discharge section is in a predetermined reference range and lower than a predetermined threshold value, pressurize the liquid discharge section by pressurizing the liquid chamber through the gas control section in a case in which the pressure is lower than the reference range.

6 Claims, 15 Drawing Sheets

(56) References Cited

U.S. PATENT DOCUMENTS

| | | | | |
|---|---|---|---|---|
| 2011/0063344 | A1* | 3/2011 | Satoh | B41J 2/17509 347/7 |
| 2013/0167940 | A1* | 7/2013 | Lavie | B41J 2/175 137/14 |
| 2015/0097900 | A1* | 4/2015 | Araki | B41J 2/175 347/85 |
| 2015/0183227 | A1* | 7/2015 | Ishikawa | B41J 2/18 347/89 |
| 2015/0290942 | A1* | 10/2015 | Gomi | B41J 2/175 347/85 |
| 2016/0288524 | A1* | 10/2016 | Ishikawa | B41J 2/18 |

* cited by examiner

LIQUID CIRCULATION DEVICE, LIQUID DISCHARGE DEVICE AND CONTROL METHOD FOR THE SAME

CROSS-REFERENCE TO RELATED APPLICATION

This application is based upon and claims the benefit of priority from Japanese Patent Application No. P2015-076789, filed Apr. 3, 2015, the entire contents of which are incorporated herein by reference.

FIELD

Embodiments described herein relate generally to a liquid circulation device, a liquid discharge device and a control method for the liquid discharge device.

BACKGROUND

A liquid discharge device is provided which supplies liquid to a liquid discharge head having a nozzle from a liquid tank and discharges the liquid from the nozzle. The liquid discharge device is a circulation type liquid discharge device that circulates the liquid between the liquid tank and the liquid discharge head. In order to prevent reduction in the liquid discharge performance in this kind of the liquid discharge device, at the time a liquid discharge signal is detected and the discharge of the liquid is carried out, the liquid is supplied to increase and adjust the pressure.

DETAILED DESCRIPTION

In accordance with an embodiment, a liquid circulation device comprises a liquid chamber, a circulation section, a liquid replenishment section, a gas control section and a control section. The liquid chamber is connected with a liquid discharge section that discharges liquid and able to hold the liquid. The circulation section circulates the liquid in a flow path containing the liquid chamber and the liquid discharge section. The liquid replenishment section replenishes the liquid to the liquid chamber. The gas control section can pressurize or decompress the liquid chamber. The control section replenishes the liquid through the liquid replenishment section in a case in which pressure of the liquid discharge section is in a predetermined reference range and lower than a predetermined threshold value, pressurizes the liquid discharge section by pressurizing the liquid chamber through the gas control section in a case in which the pressure is lower than the reference range and decompresses the liquid discharge section by decompressing the liquid chamber through the gas control section in a case in which the pressure is higher than the reference range.

Hereinafter, an inkjet recording apparatus 1 according to an embodiment is described with reference to FIG. 1 to FIG. 11. For the sake of describing in each figure, the appropriate structure is expanded, reduced or omitted to be shown.

Figure 1:
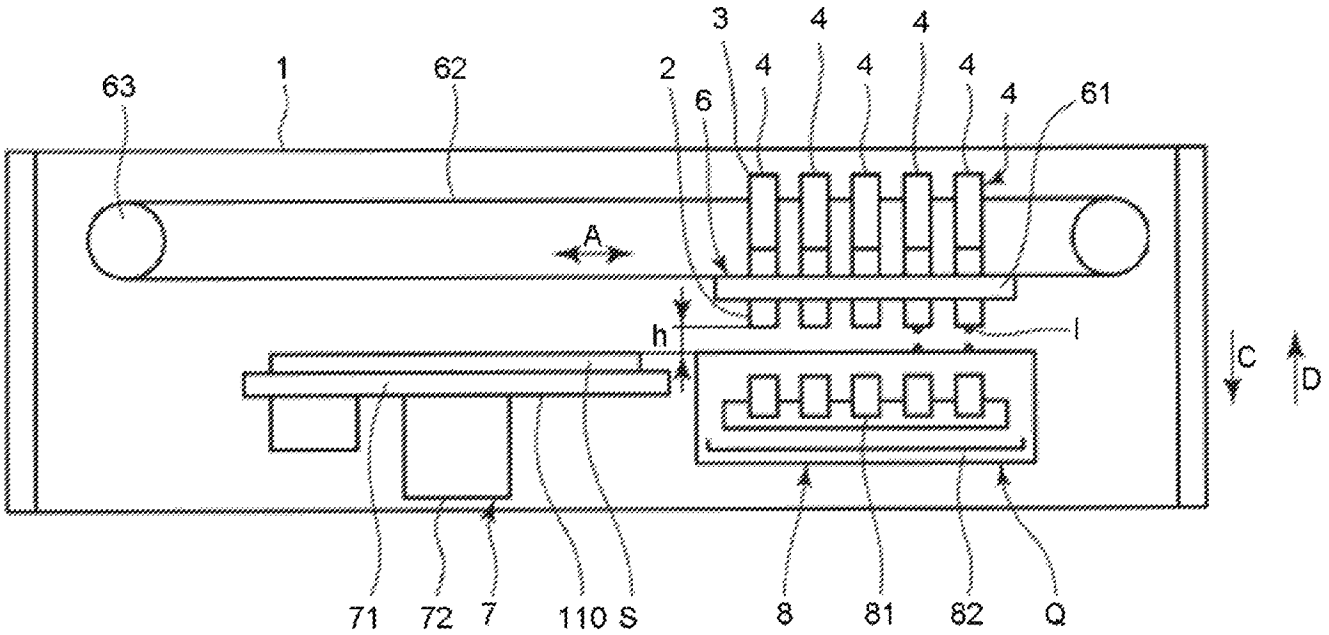
FIG. 1 is a side view of an ink jet recording apparatus according to a first embodiment.
Figure 2:
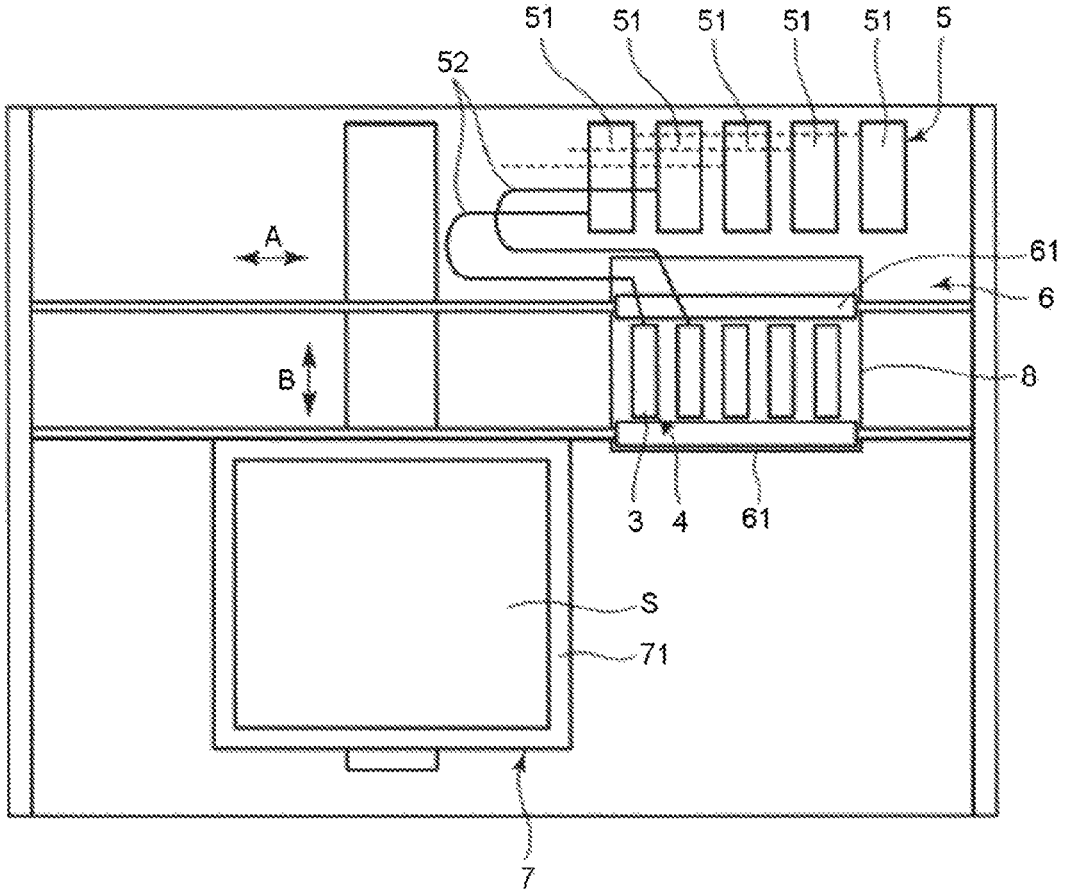
FIG. 2 is a plane view of the inkjet recording apparatus.
Figure 3:
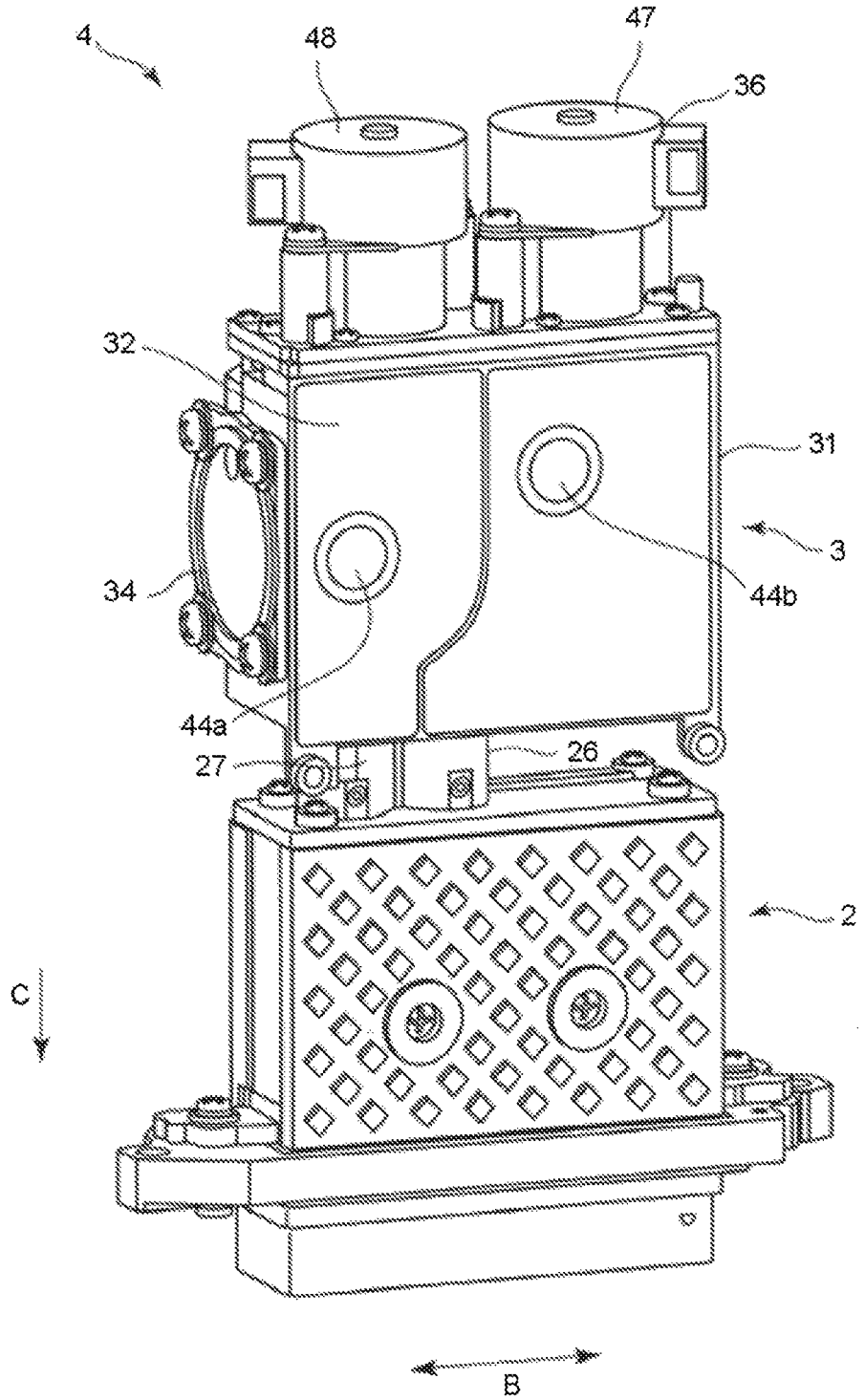
FIG. 3 is a perspective view illustrating the appearance of an ink jet head unit according to the embodiment.
Figure 4:
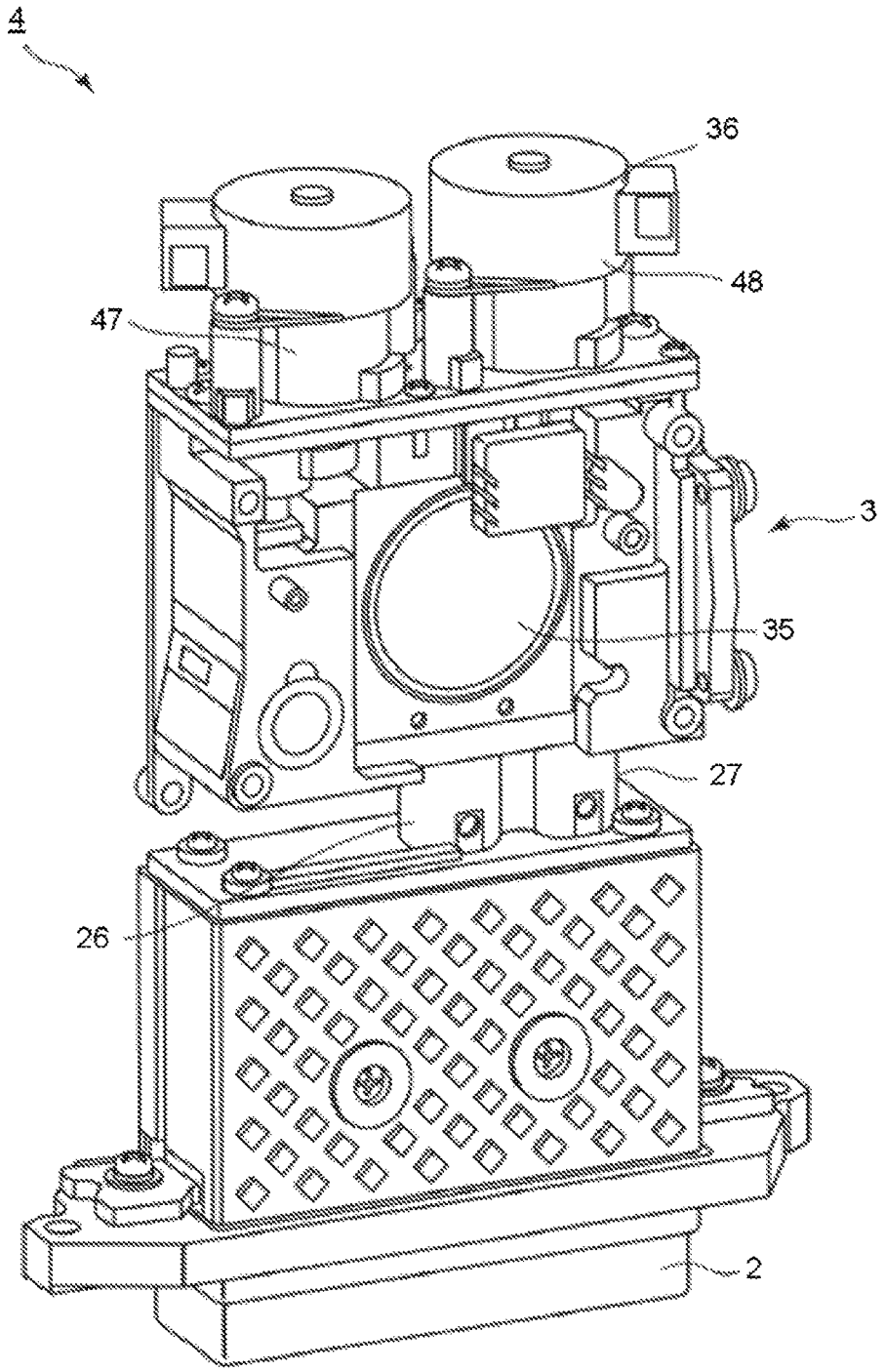
FIG. 4 is a perspective view illustrating the appearance of the ink jet head unit.
Figure 5:
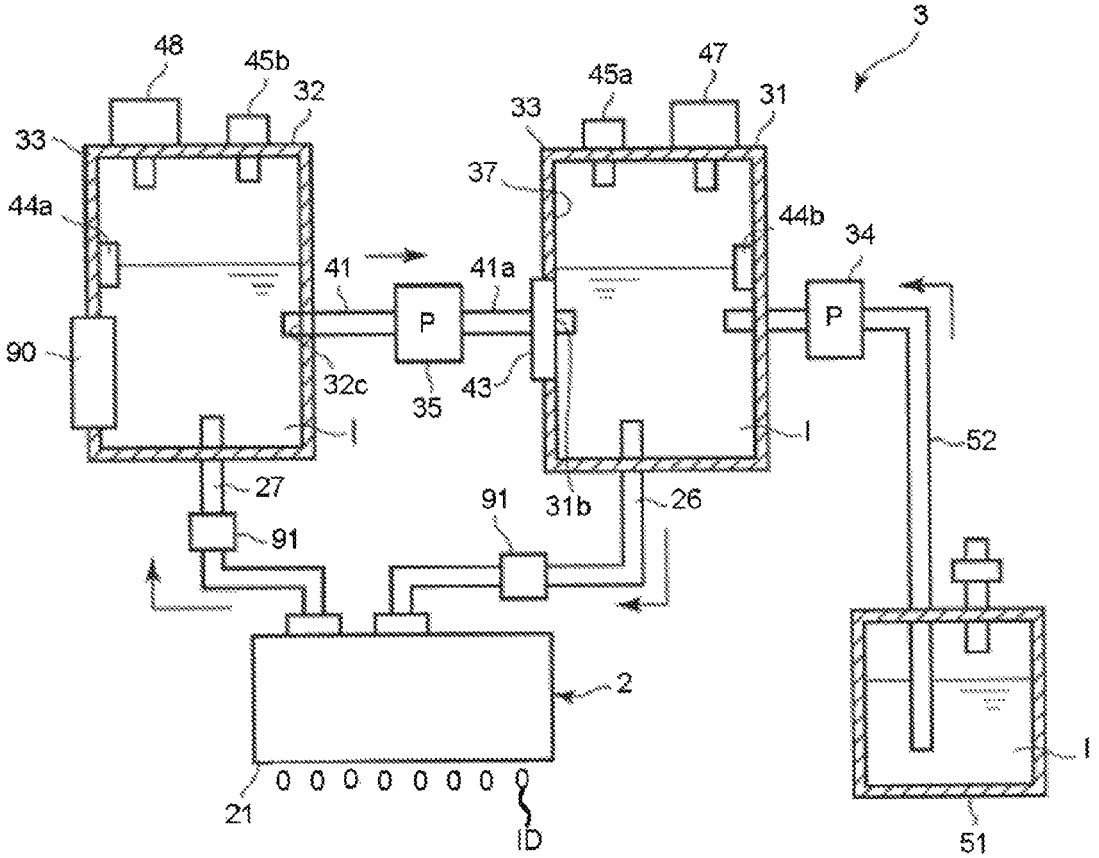
FIG. 5 is an illustration diagram illustrating the flow of liquid in the ink jet recording apparatus.
Figure 6:
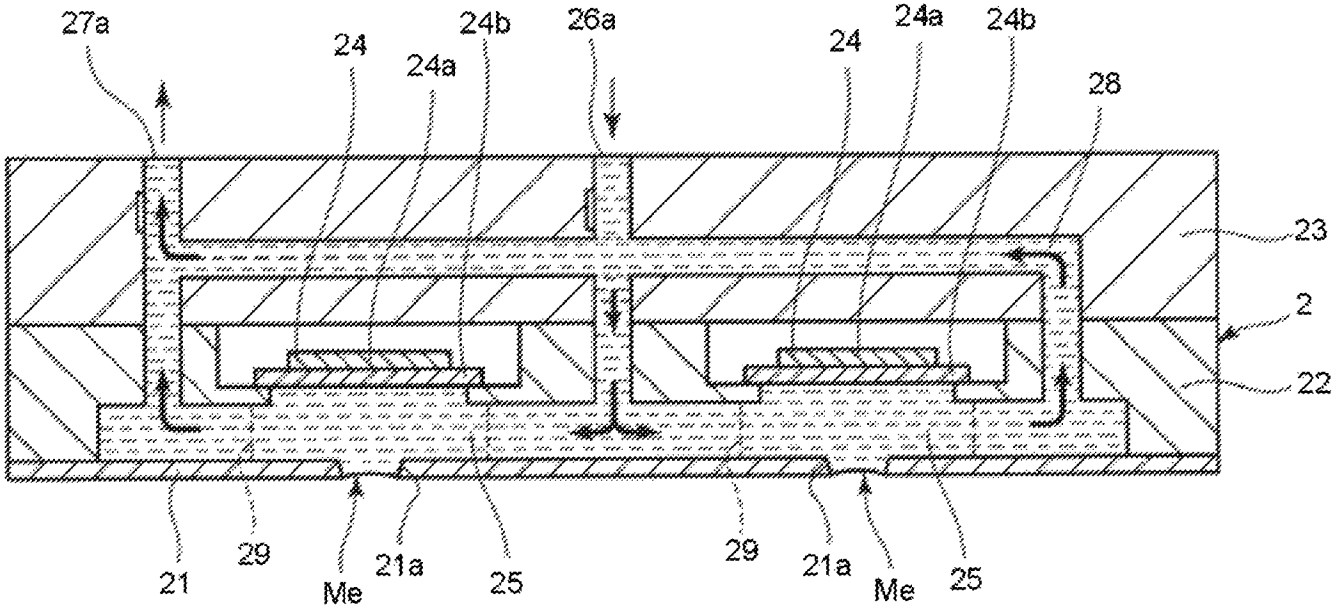
FIG. 6 is a cross-sectional view illustrating the internal structure of an ink jet head.
Figure 7:
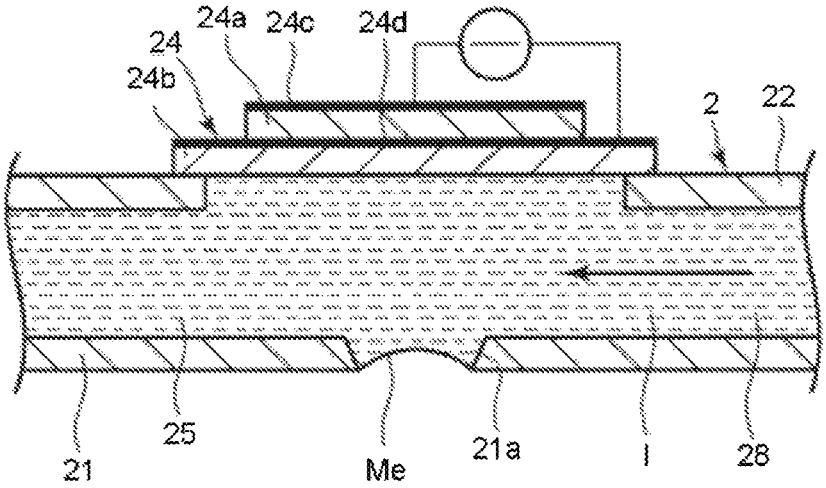
FIG. 7 is an illustration diagram illustrating a state in which ink remains in a nozzle of the ink jet head according to the embodiment.
Figure 8:
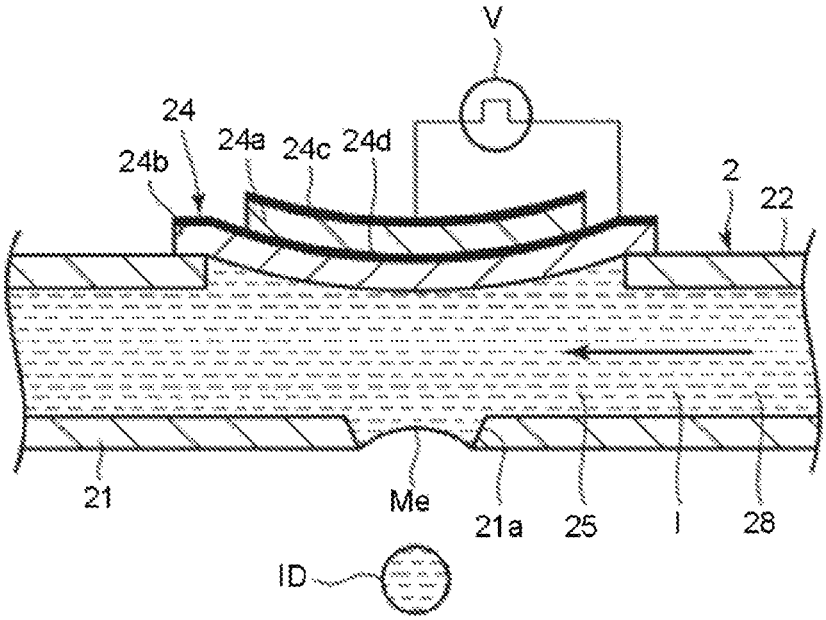
FIG. 8 is an illustration diagram illustrating a state in which an ink droplet is discharged from the nozzle of the ink jet head according to the embodiment.
Figure 9:
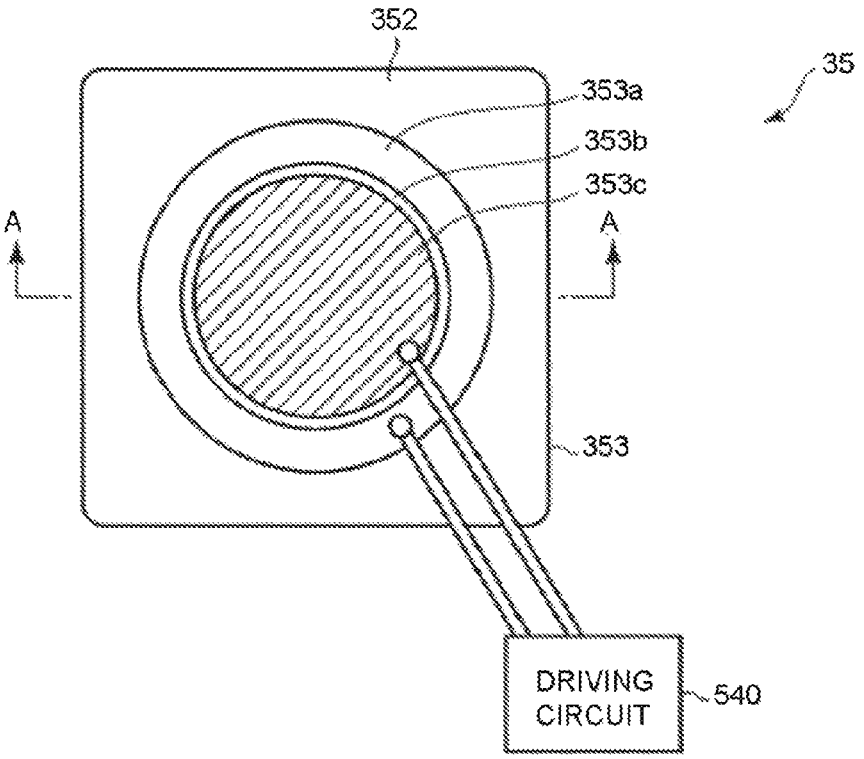
FIG. 9 is a cross-sectional view illustrating the structure of a circulation pump according to the embodiment.
Figure 10:
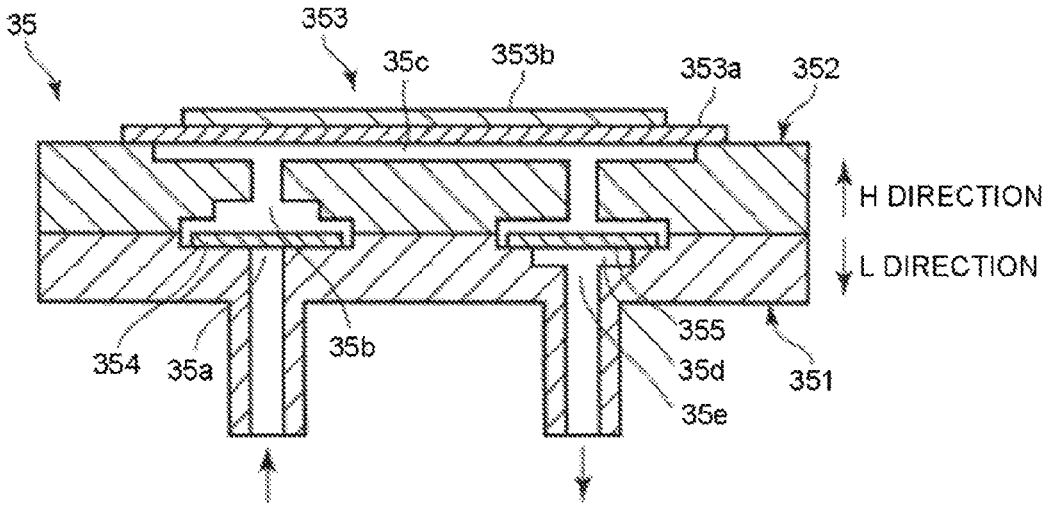
FIG. 10 is a cross-sectional view illustrating the structure of the circulation pump according to the embodiment.
Figure 11:
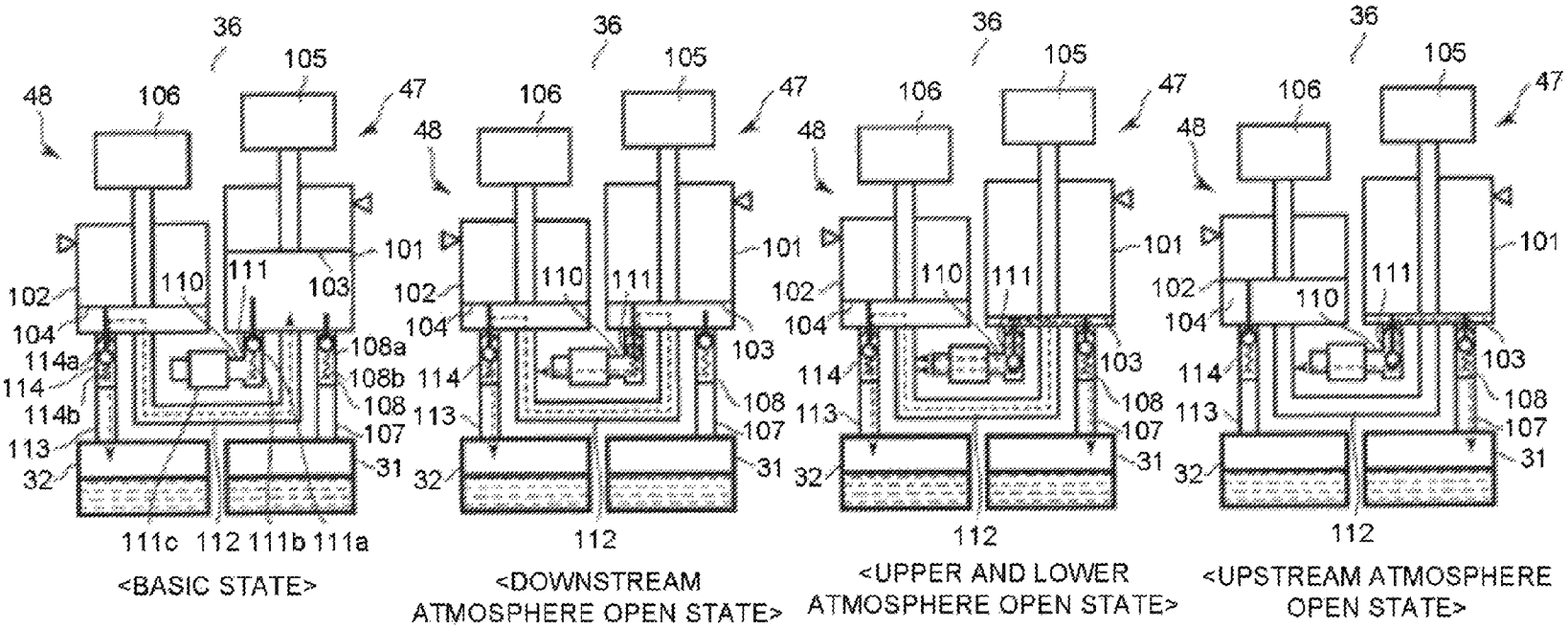
FIG. 11 is an illustration diagram illustrating the structure and operations of a pressure adjustment section according to the embodiment.
Figure 12:
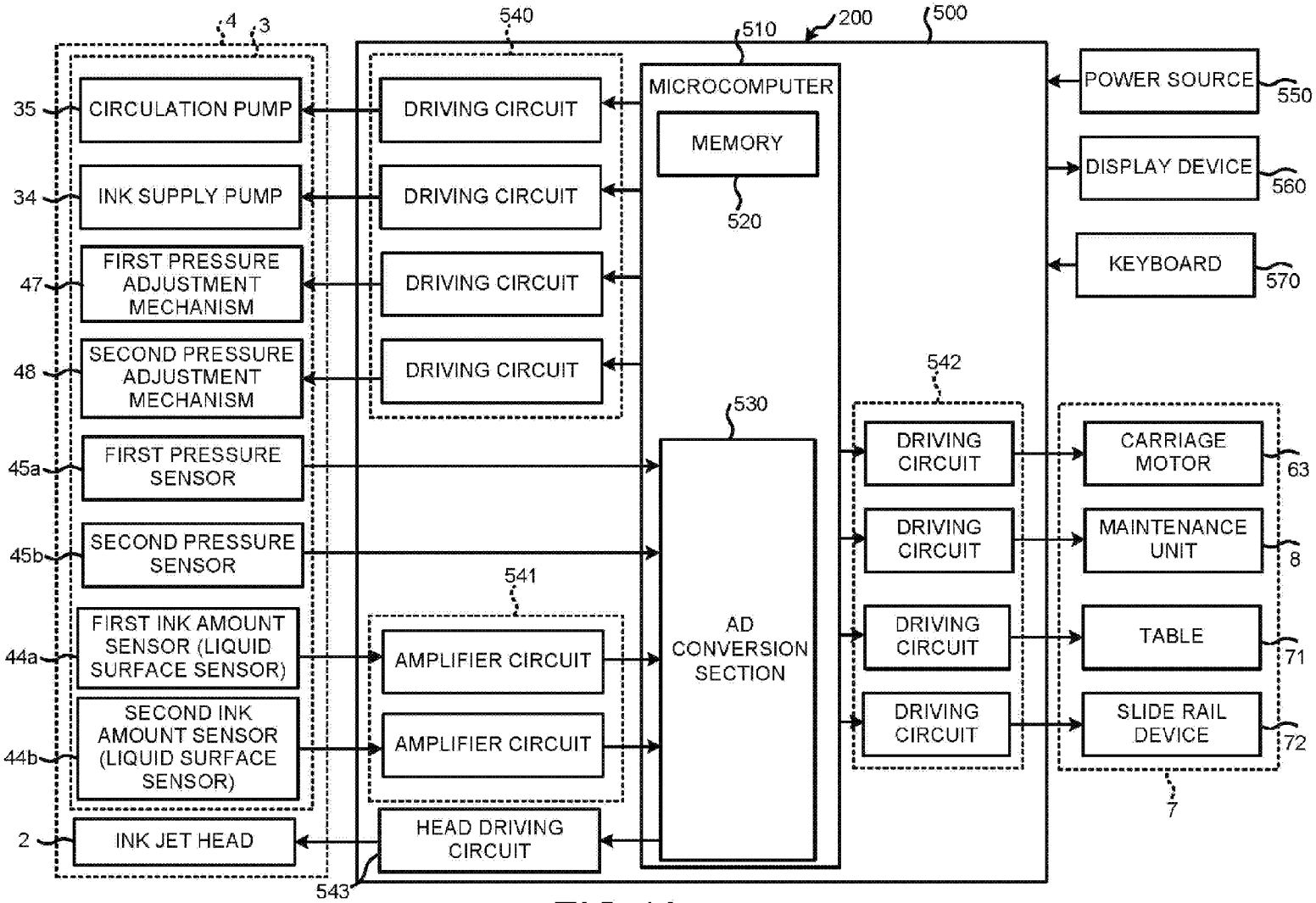
FIG. 12 is a block diagram illustrating a control system of the ink jet recording apparatus according to the embodiment.

FIG. 1 is a side view of the ink jet recording apparatus 1, and FIG. 2 is a plane view of the ink jet recording apparatus 1. FIG. 3 and FIG. 4 are perspective views illustrating the appearance of an ink jet head unit 4, and FIG. 5 is an illustration diagram illustrating the flow of liquid in the ink jet recording apparatus. FIG. 6 is a cross-sectional view illustrating the internal structure of an inkjet head 2. FIG. 7 and FIG. 8 are illustration diagrams illustrating partial operations of a nozzle of the ink jet head 2. FIG. 9 and FIG. 10 are cross-sectional views illustrating the structure of a circulation pump 35 of the ink jet head unit 4. FIG. 11 is an illustration diagram illustrating the structure and operations of a pressure adjustment section 36 as a gas control section. FIG. 12 is a block diagram illustrating a control system of the ink jet recording apparatus 1.

As shown in FIG. 1 and FIG. 2, the ink jet recording apparatus 1 serving as a liquid discharge device is provided with a plurality of ink jet head units 4 each of which integrally includes the ink jet head 2 serving as a liquid discharge section and an ink circulation device 3, an ink cartridge 5 for holding ink to be supplied to the ink jet head unit, a head support section 6 for movably supporting the ink jet head unit, an image receiving medium moving section 7 for movably supporting the image receiving medium and a maintenance unit 8.

The ink jet head unit 4 shown in FIG. 3 to FIG. 5 is provided with the ink jet head 2 and the ink circulation device 3 serving as a liquid circulation device integrally arranged on the upper part of the ink jet head 2. A plurality of the ink jet head units 4 respectively discharges, for example, cyan ink, magenta ink, yellow ink, black ink and white ink to an image receiving medium to form a desired image; however, the color or characteristic of each ink used is not limited. For example, instead of the white ink, transparent and glossy ink or special ink that develops a color when irradiated with infrared rays or ultraviolet rays may be discharged. A plurality of the ink jet heads 2 has the same structure though the ink respectively used therein is different. Thus, the plural ink jet heads 2 are described with a common sign.

The ink jet head 2 is provided with a nozzle plate 21 having a plurality of nozzles, a substrate 22 which is arranged to face the nozzle plate 21 and includes an actuator 24, and a manifold 23 bonded with the substrate 22.

The nozzle plate 21 includes a first nozzle array and a second nozzle array separately having, for example, 300 nozzles per inch. A predetermined ink flow path 28 inside the ink jet head is formed with the nozzle plate 21, the substrate 22 and the manifold 23. The ink flow path 28 is a path from a support port 26*a* formed in the manifold 23 to a plurality of the ink pressure chambers 25 communicating with the nozzle holes 21*a* through a common flow path and also from each ink pressure chamber 25 to the ink discharge port 27*a* through the common flow path.

The substrate 22 that is oppositely bonded with the nozzle plate 21 is constituted into a predetermined shape for forming the predetermined ink flow path 28 containing a plurality of ink pressure chambers 25 located between the nozzle plate 21 and the substrate 22. Actuators 24 in the substrate 22 are arranged at positions facing the ink pressure chambers 25. The substrate 22 includes bulkheads 29 arranged among a plurality of the ink pressure chambers 25 of the same array. The actuator 24 is arranged to face a nozzle hole 21*a*, and the ink pressure chamber 25 is formed between the actuator 24 and the nozzle hole 21*a*.

The manifold 23 is bonded with the upper part of the substrate 22. The manifold 23 includes a supply port and a discharge port communicating with the ink circulation device 3 and is constituted into a predetermined shape for forming the predetermined ink flow path 28 in a state of assembling with the substrate 22 and the nozzle plate 21.

The actuator 24 shown in FIG. 6 to FIG. 8 is composed of a unimorph type piezoelectric vibration plate on which, for example, a piezoelectric element 24*a* and a vibration plate 24*b* are laminated. The piezoelectric element 24*a* is made from, for example, piezoelectric ceramic material such as PZT (Lead Zirconate Titanate) and the like. The vibration plate is formed with, for example, SiN (Silicon Nitride) and the like. As shown in FIG. 7, electrodes 24*c* and 24*d* are arranged at the upper and lower parts of the piezoelectric element 24*a*. In a case in which no voltage is applied to the electrodes 24*c* and 24*d*, as the piezoelectric element 24*a* is not deformed, the actuator 24 is not deformed either. In a case in which the actuator 24 is not deformed, a meniscus Me serving as an interface of ink I and air is formed in the nozzle hole 21*a* due to surface tension of the ink. The ink I in the ink pressure chamber 25 is held in the nozzle hole 21*a* by means of the meniscus Me. In the ink jet head 2, if the pressure applied to the meniscus Me of the nozzle hole 21*a* is higher than atmosphere pressure (positive pressure), the ink I is leaked out from the nozzle hole 21*a*. If the pressure applied to the meniscus Me is lower than the atmosphere pressure (negative pressure), the ink I maintains the meniscus Me and held in the nozzle hole 21*a*.

If the nozzle hole 21*a* is arranged in such a manner that the ink I is discharged in the gravity direction (downwards), in a case in which the pressure in the ink pressure chamber 25 is greater than −0.5 kPa (the positive pressure side), the ink I is leaked out from the nozzle hole 21*a* due to slight vibration. Further, in a case in which the pressure in the ink pressure chamber 25 is smaller than −4.0 kPa (the negative pressure side), bubbles are sucked from the nozzle hole 21*a* and the discharge of the ink is failed. The amount of ink droplets discharged by each nozzle is 60~180 pl, and thus the ink jet head 2 is a so-called large-droplet discharge head.

As shown in FIG. 8, if a voltage (V) is applied to the electrodes 24*c* and 24*d*, the piezoelectric element 24*a* is deformed, and the actuator 24 is deformed as well. Because of the deformation of the actuator 24, the pressure applied to the meniscus Me is greater than the air pressure (positive pressure), and thus, the ink I breaks the meniscus Me, becomes an ink droplet ID and then is discharged from the nozzle hole 21*a*. The atmospheric pressure is set to zero, the negative pressure is lower than the atmospheric pressure, and the positive pressure is greater than the atmospheric pressure.

The ink circulation device 3 is provided with an ink casing 33 that includes a supply chamber 31 communicating with the support port 26*a* of the ink jet head 2 and a collection chamber 32 communicating with the ink discharge port 27*a* therein, a supply pump 34, a circulation pump 35 serving as a circulation section and a pressure adjustment section 36.

The ink casing 33 includes the supply chamber 31 serving as a liquid chamber which can hold the ink I and which supplies the ink I to the ink jet head 2, the collection chamber 32 serving as a liquid chamber which can hold the ink I and which collects the ink I from the ink jet head 2, and a common wall 37 between the collection chamber 32 and the supply chamber 31. The ink casing 33 is sealed against outside air.

The collection chamber 32 communicates with the ink discharge port 27*a* of the ink jet head 2 through an ink return pipe 27. A liquid hole 32*c* is formed in the collection chamber 32. The collection chamber 32 includes a first communication hole 32*d* communicating with a first pressure adjustment mechanism 47 of the pressure adjustment section 36. A heater 90 for adjusting temperature of the ink is arranged in the collection chamber 32.

The supply chamber 31 communicates with the support port 26*a* of the ink jet head 2 through an ink supply tube 26. The supply chamber 31 is connected with an ink cartridge 51 via a tube. A liquid hole 31*b* serving as a passage of the ink to be supplied is formed in the supply chamber 31.

The supply pump 34 supplies the ink held in the ink cartridge to the supply chamber 31. The supply pump 34 is, for example, a piezoelectric pump. The volume in the supply pump 34 (the volume of a pump chamber) is changed cyclically by bending the piezoelectric vibration plate obtained by bonding the piezoelectric element and a metal plate. The supply pump 34 conveys the ink from the ink cartridge 51 to the pump chamber according to the change of the volume of the pump chamber. The supply pump 34 includes a check valve that regulates the conveyance direction of the ink to only one direction from the ink cartridge 51 to the supply chamber 31. The supply pump 34 supplies the ink from the ink cartridge 51 to the supply chamber 31 through repeating expansion and contraction of the pump chamber.

As shown in FIG. 9 and FIG. 10, the ink circulation pump 35 serving as a piezoelectric pump includes a lower housing 351, an upper housing 352 and a piezoelectric actuator 353. A flow path from an inflow port 35*a* to a liquid feed port 35*e* via an absorption chamber 35*b*, a pump chamber 35*c* and a liquid feed chamber 35*d* is formed in the ink circulation pump 35. A first check valve 354 for regulating the flow direction of the ink is arranged between the inflow port 35*a* and the absorption chamber 35*b*. A second check valve for regulating the flow direction of the ink is arranged between the liquid feed chamber 35*d* and the liquid feed port 35*e*. The piezoelectric actuator 353 comprises a metal plate 353*a*, a piezoelectric ceramic 353*b* fixed on the metal plate 353*a* and an electrode 353*c* made from silver paste and the like. The electrode 353*c* and the metal plate 353*a* on the piezoelectric ceramic 353*b* are connected with a driving circuit 540 through a wiring.

If the ink circulation pump 35 enables the piezoelectric actuator 353 to operate with an alternating voltage through the driving circuit 540, the piezoelectric actuator 353 expands or contracts the pump chamber 35*c*. The ink circulation pump 35 conveys the ink I from the inflow port 35*a* to the absorption chamber 35*b*, the pump chamber 35*c*, the liquid feed chamber 35*d* and the liquid feed port 35*e* in order.

The ink circulation device 3 includes a circulation section 41 having a circulation path 41*a* from the liquid hole 32*c* of the collection chamber 32 to the liquid hole 31*b* of the supply chamber 31. The circulation section 41 includes the circulation pump 35 and a filter 43 on the circulation path 41*a*. The circulation pump 35 is arranged across the adjacent collection chamber 32 and the supply chamber 31. The circulation pump 35 circulates the ink I from the collection chamber 32 to the collection chamber 32 again via the ink supply chamber 31 and the ink jet head 2.

The circulation section 41 absorbs the ink from the liquid hole 32*c* of the collection chamber 32 and feeds the ink I to the liquid hole 32*b* of the supply chamber 31. For example, a tube pump, a diaphragm pump or a piston pump may be used as the circulation pump 35.

The filter 43 which is located at, for example, the downstream side of the circulation pump 35 on the circulation path 41*a* in the circulation direction removes a foreign substance mixed into the ink I. For example, a polypropylene mesh filter, a nylon mesh filter, a polyphenylene sulfide mesh filter, or a stainless steel mesh filter is used as the filter 43.

While the ink is circulated from the collection chamber 32 to the supply chamber 31 through the circulation section 41, the bubble in the ink I rises in a direction (upwards) opposite to the gravity direction due to buoyancy. The bubble rising due to the buoyancy moves to an air chamber above the liquid surface of the collection chamber 32 or the liquid surface of the supply chamber 31 to be removed from the ink. Further, the filter 43 may be located nearby an entrance to the ink supply tube 26 inside the supply chamber 31.

The ink circulation device 3 comprises a first ink amount sensor (liquid surface sensor) 44*a* for measuring ink amount in the collection chamber 32 and a second ink amount sensor (liquid surface sensor) 44*b* for measuring ink amount in the supply chamber 31, as shown in FIG. 5. The first ink amount sensor (liquid surface sensor) 44*a* and the second ink amount sensor (liquid surface sensor) 44*b* vibrate, for example, the piezoelectric vibration plate with an alternating voltage and respectively detect the vibration of the ink transmitting through the collection chamber 32 and the supply chamber 31 to measure the ink amount. No limitations are given to the structure of the ink amount sensor, and the ink amount sensor may be used to measure heights of the first liquid surface $\alpha 1$ and the second liquid surface $\alpha 2$. The ink circulation device 3 further includes a temperature sensor 91 for detecting the temperature of the ink.

The ink circulation device 3 comprises a first pressure sensor 45*a* serving as a pressure detection section for detecting pressure in the collection chamber 32 and a second pressure sensor 45*b* serving as a pressure detection section for detecting pressure in the supply chamber 31. The pressure sensors 45*a* and 45*b* each are, for example, a semiconductor piezoresistive pressure sensor for outputting the pressure as an electrical signal. The semiconductor piezoresistive pressure sensor that includes a diaphragm that receives pressure from the external and a semiconductor strain gauge formed at the surface of the diaphragm converts the change of electric resistance due to piezoresistive effect generated in the strain gauge into the electrical signal together with the deformation of the diaphragm due to the pressure from the external to detect the pressure.

As shown in FIG. 11, the pressure adjustment section 36 includes a first pressure adjustment mechanism 47 and a second pressure adjustment mechanism 48.

The first pressure adjustment section 47 includes a cylinder 101 serving as a first gas chamber communicably connected with the supply chamber 31, a piston 103 that reciprocates in the cylinder 101 and a stepping motor 105 serving as a first volume variable section that enables the piston 103 to reciprocate up and down (in the H direction) and which makes the volume of cylinder 101 changed.

The cylinder 101 communicates with the supply chamber 31 via a communication pipe 107.

A first opening and closing section 108 for opening and closing the communication pipe 107 is arranged inside the communication pipe 107. The first opening and closing section 108 comprises an on-off valve 108*a* and a spring 108*b* for energizing the on-off valve 108*a*. The on-off valve 108*a* is capable of closing the communication pipe 107 communicating the cylinder 101 and the supply chamber 31 through the energization applied by the spring 108*b* and moving through the pressure of the piston 103 to open the communication pipe 107.

Further, the cylinder 101 communicates with the atmosphere through a communication pipe 110.

A second opening and closing section 111 capable of opening and closing a cylinder 102 against the atmosphere is arranged inside the communication pipe 110. The second opening and closing section 111 comprises an on-off valve 111*a* and a spring nib for energizing the on-off valve 111*a*. The on-off valve 111*a* is capable of closing the communication pipe 110 through the energization applied by the spring nib and opening the communication pipe 110 communicating with the atmosphere through the pressure of the piston 103. A filter 111*c* is arranged at the side of the atmosphere of the communication pipe 110.

The cylinder 101 of the first pressure adjustment section 47 usually connects and communicates with the cylinder 102 of the second pressure adjustment section 48 via a communication passage 112.

The second pressure adjustment section 48 includes a cylinder 102 serving as a second gas chamber communicable with the collection chamber 32, a piston 104 arranged in the cylinder 102 and a pulse motor 106 serving as a second volume variable section which enables the piston 104 to move up and down (in the H direction) and which makes the volume of the cylinder 102 changed.

The cylinder 102 communicates with the collection chamber 32 via a communication pipe 113.

A third opening and closing section 114 for switching the communication state of the collection chamber 32 and the cylinder 102 is arranged inside the communication pipe 113. The third opening and closing section 114 comprises an on-off valve 114*a* and a spring 114*b* for energizing the on-off valve 114*a*. The on-off valve 114*a* is capable of closing the communication pipe 113 communicating with the collection chamber 32 through the energization applied by the spring 114*b* and opening the communication pipe 113 through the pressure of the piston 104.

It is possible that the pressure adjustment section 36 respectively presses or releases the press on the opening and closing valves 108*a*, 111*a* and 114*a* to switch opening and closing operations of the first opening and closing section 108, the second opening and closing section 111 and the third opening and closing section 114 according to the operations of the pistons 103 and 104 in the cylinders 101 and 102. Further, the pressure adjustment section 36 can increase or decrease the volumes of the gas chambers in the cylinders 101 and 102 according to the operations of the pistons 103 and 104.

It is possible that the state of the pressure adjustment section 36 is switched among four states consisting of a basic state, a downstream atmosphere open state, an upper and lower atmosphere open state and an upstream atmosphere open state.

In the basic state, the first opening and closing section 108 and the second opening and closing section 111 are in the close state and the third opening and closing section 114 is in the open state, and the supply chamber 31 is sealed. It is possible that the pressure adjustment section 36, in the basic state, raises or lowers the piston 103 to increase or decrease the Volume of the gas chamber in the cylinder 102 communicating with the collection chamber 32 and pressurizes or decompresses the collection chamber 32 to pressurize or decompress the ink jet head 2.

The ink circulation device 3 circulate, the ink through the circulation section 41, supplies the ink to the ink jet head 2, and absorbs the bubble or removes the foreign substance contained in the ink I. Further, the ink circulation device 3 adjusts the pressure of the ink pressure chamber 25 and the pressure of the meniscus Me in the nozzle hole 21*a*. For example, in the ink jet recording apparatus 1, by means of the pressure adjustment under the air control of the pressure adjustment section 36 and the ink replenishment control of the supply pump 34, the pressure of the meniscus Me is maintained in a range of −2.0 kPa~−0.8 kPa to prevent unnecessary ink leakage or absorption of bubbles.

The ink cartridge 51 shown in FIG. 2 communicates with the ink circulation device 3 of the ink jet head unit 4 via a tube 52. The ink cartridge 51 is arranged below the ink circulation device 3 in the gravity direction. In the present embodiment, head pressure of the ink in the ink cartridge 51 keeps lower than setting pressure of the supply chamber 31 by arranging the ink cartridge 51 below the ink circulation device 3 in the gravity direction. Only when being driven, the supply pump 34 supplies new ink from the ink cartridge 51 to the supply chamber 31 by arranging the ink cartridge 51 below the ink circulation device 3.

The head support section 6 includes a carriage 61 that supports the ink jet head unit 4, a conveyance belt 62 that enables the carriage 61 to reciprocate in an arrow A direction and a carriage motor 63 that drives the conveyance belt 62.

The image receiving medium moving section 7 includes a table 71 that adsorbs and fixes the image receiving medium S. The table 71 is mounted on a slide rail device 72 to reciprocate in an arrow B direction.

The maintenance unit 8 is in a scanning range of the ink jet head unit 4 in the arrow A direction and arranged at a position outside the moving range of the table 71. The maintenance unit 8 is a case of which upper part is opened and is arranged to be removable in the vertical direction (in arrows C and D directions shown in FIG. 1).

The maintenance unit 8 comprises a rubber plate 81 and a waste ink receiving section 82. The rubber plate 81 removes ink, dirt, and paper dust adhering to the nozzle plate 21 of the ink jet head 2. The waste ink receiving section 82 receives waste ink, dirt and paper dust generated when a maintenance operation is carried out. The maintenance unit 8 is equipped with a mechanism that enables the plate 81 to move in the arrow B direction and wipes the surface of the nozzle plate 21 with the plate 81.

A control system for controlling the operations of the ink jet recording apparatus 1 is described with reference to a block diagram shown in FIG. 12. The control substrate 500 comprises a micom (microcomputer) 510 serving as a control section that controls the whole of the ink jet recording apparatus 1, a circulation device driving circuit 540 that drives the ink circulation device 3, an amplifier circuit 541, a moving section driving circuit 542 that drives the image receiving medium moving section 7 and a head driving circuit 543 that drives the ink jet head 2. The ink jet head unit 4 consists of the ink circulation device 3 and the ink jet head 2. The microcomputer 510 includes a memory 520 that stores programs or various kinds of data and an AD conversion section 530 that acquires an output voltage from the ink circulation device 3 of the ink jet head unit 4.

The microcomputer 510 has a function of acquiring information detected by the first pressure sensor 45*a*, the second pressure sensor 45*b* and the liquid surface sensors 44*a* and 44*b* through the AD conversion section 530.

The microcomputer 510 has a function of controlling the operations of the ink circulation pump 35 to circulate the ink. The microcomputer 510 further has a function of controlling the operations of the pressure adjustment section 36 or the supply pump 34 to carry out a pressure adjustment processing according to the pressure from the pressure sensors 45*a* and 45*b*.

Furthermore, the microcomputer 510 has a function of controlling the energization of the heater 90 to make the temperature of the ink maintained within a predetermined range in a case in which the temperature of the ink I is lower than a proper temperature range in which the ink I is discharged.

The control substrate 500 is connected with a power source 550, a display device 560 for displaying the status of the ink jet recording apparatus 1 and a keyboard 570 serving as an input device. The control substrate 500 is connected with driving sections of various pumps and various sensors of the ink jet head unit 4. The control substrate 500 is further connected with the table 71 and the slide rail device 72 of the image receiving medium moving section 7, the driving section of the maintenance unit 8, and the carriage motor 63 of the conveyance belt 62.

Hereinafter, the operations of the ink jet recording apparatus 1 are described. In a case in which the ink jet recording apparatus 1 carries out a printing operation initially, the ink I is filled into the ink jet head unit 4 from the ink cartridge 51.

In order to fill the ink I, the microcomputer 510 controls to enable the ink jet head unit 4 to return to a standby position and enable the maintenance unit 8 to rise in the arrow D direction to cover the nozzle plate 21. The microcomputer 510 drives the supply pump 34 to supply the ink from the ink cartridge 51 to the supply chamber 31. If the ink I in the supply chamber 31 reaches the liquid hole 31*b*, the microcomputer 510 adjusts the pressure of the ink casing 33 through the pressure adjustment section 36 and drives the circulation pump 35.

The ink jet recording apparatus 1 respectively fills a plurality of the ink jet head units 4 with cyan ink, magenta ink, yellow ink, black ink and white ink in a plurality of the ink cartridges 51 initially.

If the ink I reaches the liquid hole 32*c* of the collection chamber 32 and the liquid hole 31*b* of the supply chamber 31, the microcomputer 510 completes the initial filling of the ink I.

In a case in which the initial filling of the ink I is completed, the pressure in the ink casing 33 is maintained at the negative pressure so that no ink I is leaked out from the nozzle hole 21*a* of the ink jet head 2 and no bubble is absorbed from the nozzle hole 21*a*. The meniscus Me in the nozzle hole 21*a* is kept at the negative pressure due to the negative pressure of the ink casing 33. Even if the power source 550 of the ink jet recording apparatus 1 is cut off in a state in which the initial filling of the ink I is completed, the ink casing 33 is in a sealed state and the meniscus Me in the nozzle hole 21*a* is kept at the negative pressure, thereby preventing the leakage of the ink.

If the printing operation is started, the microcomputer 510 controls the image receiving medium moving section 7 to adsorb and fix the image receiving medium S on the table 71 and to enable the table 71 to reciprocate in the arrow B direction. The microcomputer 510 moves the maintenance unit 8 in the arrow C direction. Further, the microcomputer 510 controls the carriage motor 63 to convey the carriage 61 in the direction of the image receiving medium S and to enable the carriage 61 to reciprocate in the arrow A direction.

When the ink jet head unit 4 reciprocates along the conveyance belt 62 in the arrow A direction, a distance h between the nozzle plate 21 of the ink jet head 2 and the image receiving medium S is kept constant.

While the ink jet head 2 reciprocates in a direction orthogonal to the conveyance direction of the image receiving medium S, an image is formed on the image receiving medium S. The ink jet head 2 discharges the ink I from the nozzle hole 21*a* arranged on the nozzle plate 21 matching with an image forming signal to form the image on the image receiving medium S.

The microcomputer 510 selectively drives the actuator 24 of the ink jet head 2 and discharges the ink droplet ID on the image receiving medium S from the nozzle hole 21*a* according to an image signal corresponding to image data stored by the memory 520. The microcomputer 510 drives the circulation pump 35. The ink I flowing back from the ink jet head 2 circulates via the collection chamber 32, the circulation pump 35, the filter 43 and the supply chamber 31 and is supplied to the in jet head 2.

The ink jet recording apparatus 1 removes the bubble and the foreign substance mixed into the ink I through the circulation of the ink I and excellently maintains the ink discharge performance. Thus, the print image quality of the ink jet head unit 4 is improved.

The pressure of the ink casing 33 changes according to the discharge of the ink droplet ID from the nozzle hole 21*a* or the drive of the circulation pump 35. The microcomputer 510 adjusts the pressure of the ink casing 33 so as to maintain the pressure of the ink casing 33 in a stable region in which no ink leaks from the nozzle hole 21*a* or no bubble is absorbed from the nozzle hole 21*a*.

The microcomputer 510 switches between the drive of the first pressure adjustment mechanism 47 and the second pressure adjustment mechanism 48 of the pressure adjustment section 36 and the drive of the supply pump 34 to adjust the pressure of the ink casing 33.

For example, if the ink droplet ID is discharged from the nozzle hole 21*a* at the time of the printing, the ink amount of the ink casing 33 is decreased instantaneously and the pressure of the collection chamber 32 is reduced. The microcomputer 510 drives the pressure adjustment section 36 or the supply pump 34 according to the detection results of the first pressure sensor 45*a*, the second pressure sensor 45*b*, the first ink amount sensor (liquid surface sensor) 44*a* and the second ink amount sensor (liquid surface sensor) 44*b*.

Figure 13:
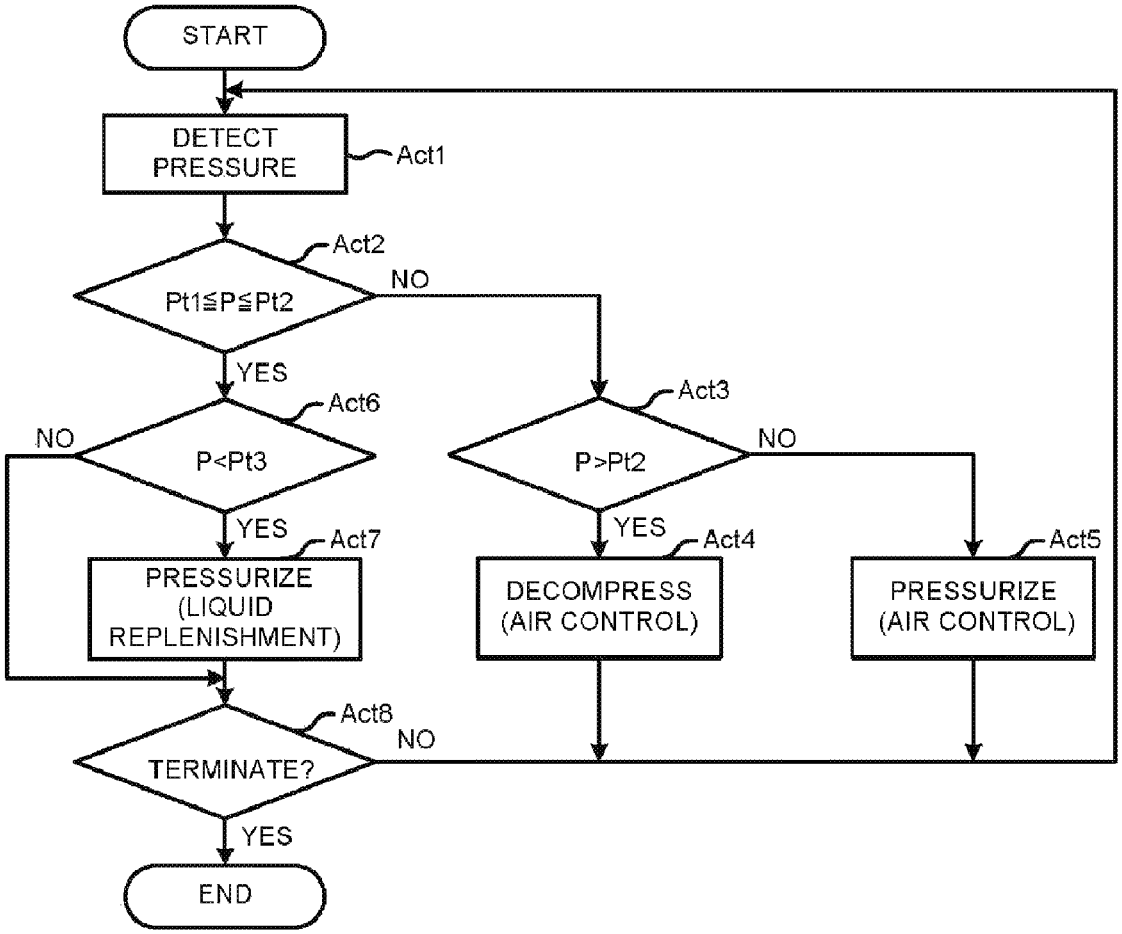
FIG. 13 is a flowchart illustrating a pressure adjustment processing of the ink jet head unit according to the embodiment.
Figure 14:
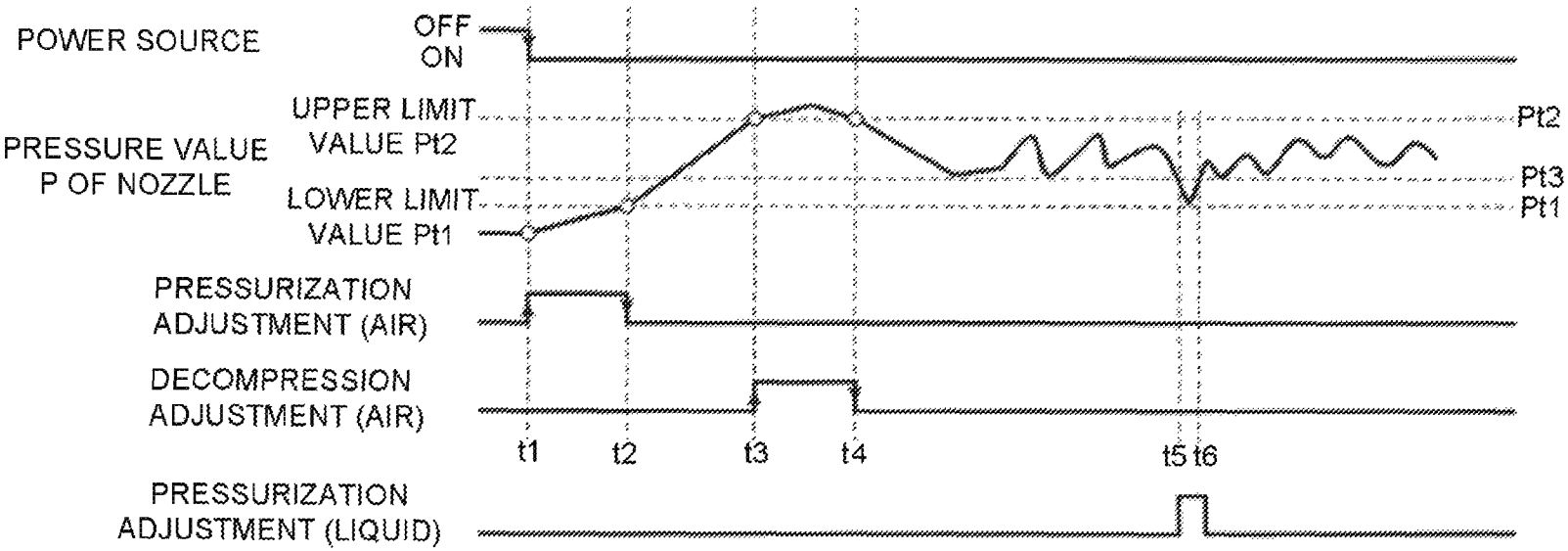
FIG. 14 is a time chart illustrating the operations of the ink jet recording apparatus and fluctuation of a pressure value according to the embodiment.

A pressure adjustment method for adjusting the pressure applied to the nozzle hole 21*a* and a control method for the ink jet recording apparatus are described with reference to FIG. 13 and FIG. 14. FIG. 13 is a flowchart illustrating pressure adjustment procedures, and FIG. 14 is a timing chart illustrating a pressure adjustment processing and a graph exemplifying a pressure value in a case of carrying out the pressure adjustment processing.

In the ink jet head unit 4, a lower limit value of the stable region of a pressure value P of the nozzle hole 21*a* in which no ink leaks from the nozzle hole 21*a* or no bubble is absorbed from the nozzle hole 21*a* is set to, for example, Pt1 and a upper limit value thereof is set to, for example, Pt2. The Pt1 and the Pt2 are set based on a proper range of the pressure of the supply chamber 31 and the collection chamber 32 for properly maintaining the meniscus Me in the nozzle hole 21*a*.

As shown in FIG. 13, after the power source 550 is turned on, the pressure value P of the nozzle hole 21*a* is calculated (Act 1) according to a pressure value P1 of the collection chamber 32 detected by the first pressure sensor 45*a* and a pressure value P2 of the supply chamber 31 detected by the second pressure sensor 45*b*.

Then, it is determined whether or not the pressure value P is in the stable region, in other words, whether or not the pressure value P meets an equation "Pt1≤P≤Pt2" (Act 2).

In a case in which the pressure value P does not meet the equation "Pt1≤P≤Pt2", it is determined whether or not the pressure value P exceeds the upper limit value of the stable region, in other words, whether or not the pressure value P meets an equation. "P>Pt2" (Act 3). The Pt1 and the Pt2 serving as reference values of the proper range are separately set to, for example, −1.1 kPa and −0.9 kPa.

In a case in which the pressure value P does not meet the equation "Pt1≤P≤Pt2" (No in Act 2) and meets the equation "P>Pt2" (Yes in Act 3), that is, in a case in which the pressure value P is higher than the upper limit value Pt2, the microcomputer 510 drives the pressure adjustment section 36 to carry out a decompression adjustment processing that decompresses the inside of the ink casing 33 and the circulation flow path through the air control (Act 4). After the decompression adjustment processing is carried out, the microcomputer 510 returns to the processing in Act 1.

In a case in which the pressure value P does not meet the equations "Pt1≤P≤Pt2" (No in Act 2) and "P>Pt2" (No in Act 3), that is, in a case in which the pressure value P is lower than the lower limit value Pt1 (that is, in a case of P<Pt1) the microcomputer 510 drives the pressure adjustment section 36 to carry out a pressurization adjustment processing that pressurizes the inside of the ink casing 33 and the circulation flow path through the air control (Act 5). At this time, no liquid is replenished. After the pressurization adjustment processing is carried out, the microcomputer 510 returns to the processing in Act 1.

On the other hand, in a case in which the pressure value P meets the equation "Pt1≤P≤Pt2" (Yes in Act 2), the microcomputer 510 determines whether or not the pressure value P is smaller than a predetermined threshold value Pt3, in other words, whether or not the pressure value P meets an equation "P<Pt3" (Act 6). The Pt3 is set based on a large amount of data detected and recorded at the time the negative pressure control enters a stable operation state except at the time the power is turned on or at the time of the initial negative pressure control immediately after the ink is filled. For example, in a state in which no printing operation is being carried out, the Pt3 is set as the lowest pressure value among 100 or 10 past data before detected (for example, one data is detected in a time equal to or smaller than 2 ms). The Pt3 is regulated within, for example, Pt1~Pt2.

In a case in which the pressure value P meets the equation "P<Pt3" in other words, in a case in which the pressure value P is smaller than the pressure threshold value Pt3 set randomly (Yes in Act 6), the microcomputer 510 drives the supply pump 34 to carry out a liquid replenishment operation that replenishes the new ink to the ink casing 33 to pressurize the ink casing 33 (Act 7). At this time, the pressure adjustment section 36 does not carry out the pressurization adjustment processing. After the pressurization adjustment processing is carried out through the liquid replenishment operation, the microcomputer 510 returns to the processing in Act 1.

After the pressurization adjustment processing and the decompression adjustment processing, if the pressure value P detected by the processing in Act 1 reaches a range from the lower limit value Pt1 to the upper limit value Pt2 that is, the pressure value P meets the equation "Pt1≤P≤Pt2" (Yes in Act 2), the microcomputer 510 stops the pressurization adjustment processing and the decompression adjustment processing.

In a case in which the pressure value P does not meet the equation "P<Pt3", in other words, in a case in which the pressure value P is equal to or greater than the pressure threshold value Pt3 set randomly (No in Act 6), the microcomputer 510 proceeds to a processing in Act 8.

That is, the microcomputer 510 selectively carries out either of the pressure adjustment operation carried out by the pressure adjustment section 36 and the liquid replenishment operation carried out by the supply pump 34 in the ink jet head unit 4 according to a relationship between the pressure value and the pressure threshold value Pt3.

Then, the foregoing operations (Act1-Act7) is repeated until the pressure adjustment processing is terminated due to, for example, power-off (Act8).

In an example shown in FIG. 14, the microcomputer 510 drives the pressure adjustment section 36 to carry out the pressurization adjustment processing through the air control at t1~t2. Further, the microcomputer 510 drives the pressure adjustment section 36 to carry out the decompression adjustment processing through the air control at t3~t4. Furthermore, the microcomputer 510 drives the supply pump 34 to carry out the liquid replenishment operation.

According to the present embodiment, it is possible to detect the printing state and to properly maintain the meniscus Me of the nozzle hole 21*a* according to the information of the pressure of the supply chamber and the collection chamber in the circulation flow path. Thus, for example, the microcomputer 510 can be a so-called stand-alone computer as it is unnecessary to use the printing signal at the ink jet recording apparatus side.

Figure 15:
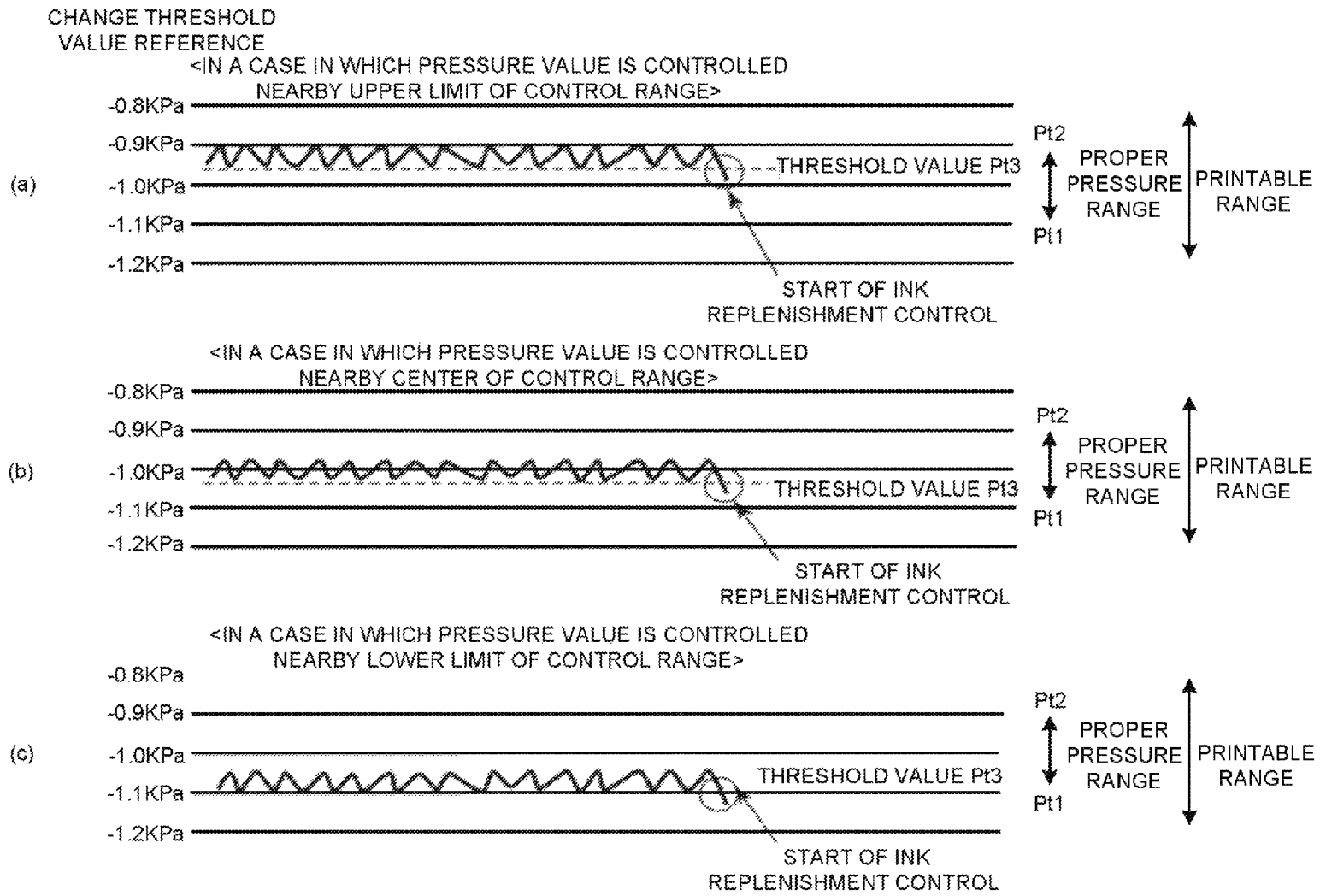
FIG. 15 is a graph illustrating the fluctuation of the pressure value in pressure control of the ink jet recording apparatus.
Figure 16:
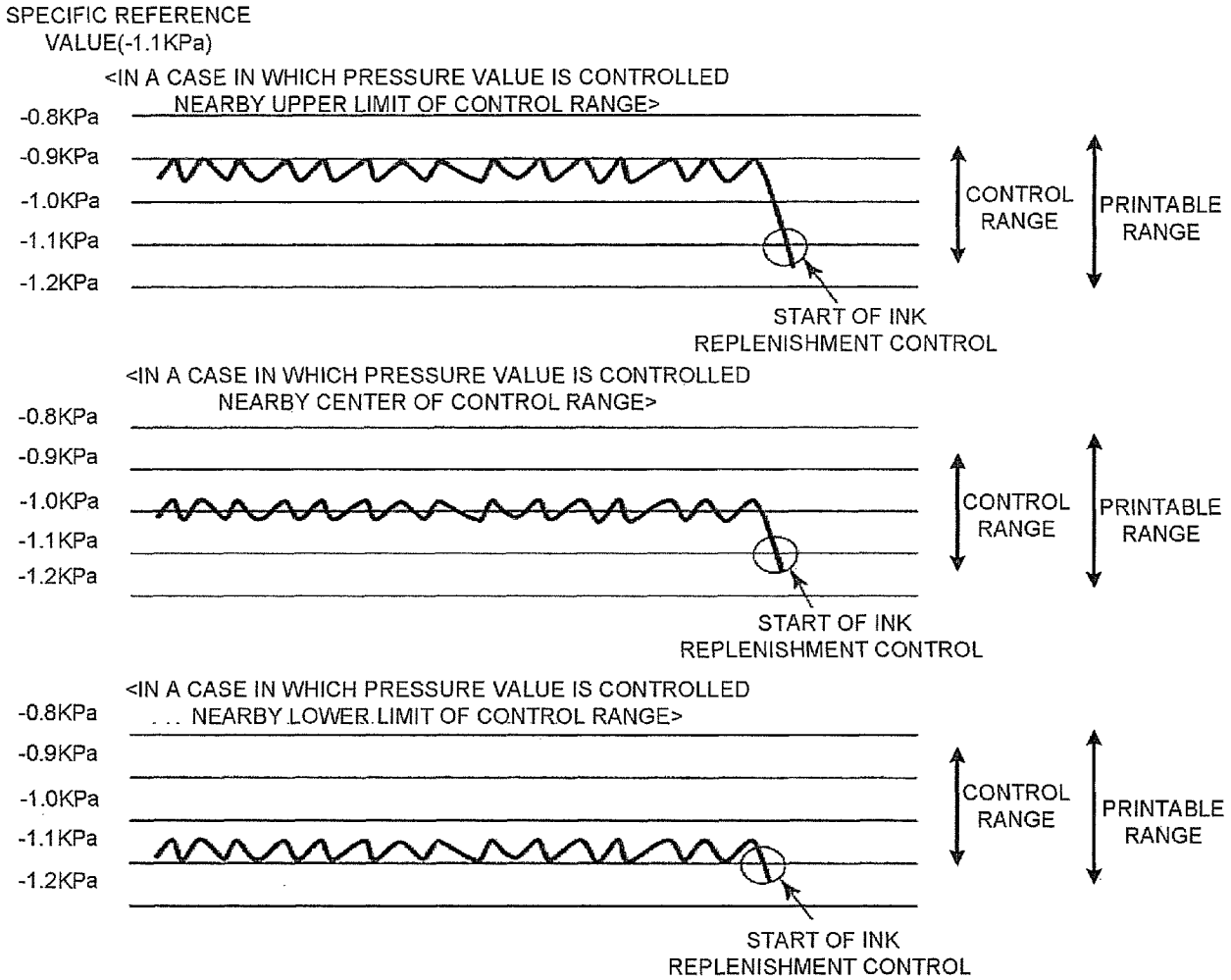
FIG.16 PRIOR ART
FIG. 16 is a graph illustrating the fluctuation of the pressure value in the pressure control on the basis of a predetermined reference value.

In the foregoing embodiment, through the setting of the threshold value serving as the reference value of the liquid replenishment operation according to the past data, the printing operation can be quickly detected as the threshold value suitable to the state of the pressure control can be set. That is, as shown in FIG. 16, for example, a comparative example, in a case in which the liquid replenishment operation is controlled based on the a specific reference value, the time taken to reach the reference value varies depending on the height of transition of the pressure in the proper range. That is, in the proper range, the time taken to reach the reference value in a case in which the transition of the pressure is carried out in the vicinity of the upper limit and that in a case in which the transition of the pressure is carried out in the vicinity of the lower limit are different, and the detection of the printing operation accompanying with the discharge of the liquid becomes slow in some cases. In this case, the pressure of an orifice surface of the ink jet head becomes an excessive negative pressure after the printing operation is started and the printing operation is failure in a case of a large droplet particularly. On the contrary, in the present embodiment, as the threshold value is set depending on the past pressure values, as shown in FIG. 15, even if the pressure fluctuates, the reduction of the pressure can be detected immediately at the point in time when the pressure is smaller than the minimum of a large amount of the past data. Thus, the reduction of the pressure caused by the start of the printing operation can be detected quickly, the excessive negative pressure of the orifice surface of the inkjet head caused by the start of the printing operation can be prevented and the high liquid discharge performance can be guaranteed.

In the foregoing embodiment, the reduction of the ink I in the supply chamber 31 and the collection chamber 32 of the ink circulation device 3 caused by the discharge operation of the large droplet can be suppressed through suppressing the decompression in the negative pressure immediately.

Figure 17:
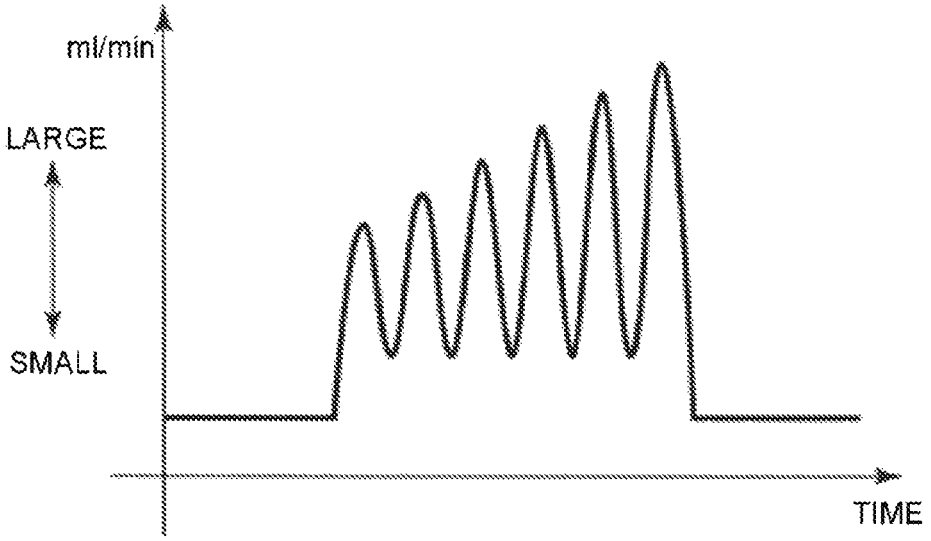
FIG. 17 is an illustration diagram illustrating a pressure adjustment processing of an ink jet recording apparatus according to another embodiment.

Further, it is also possible that drive output of the supply dump 34 is changed gradually as another embodiment for example, as shown in FIG. 17. In the present embodiment, in a case of carrying out the liquid replenishment operation, the microcomputer 510 adjusts a duty ratio of the supply dump 34, controls to gradually increase the times of the operations of the pump per, unit time and adjusts flow rate or flow velocity of the liquid to be replenished. For example, in a case in which a diaphragm type piezoelectric pump is used as the supply dump 34, "ON-OFF" is repeated at a drive frequency pitch of the pump during an "ON" operation. In this case, the operation initial output is gradually changed.

According to the embodiment, the initial sudden pressure change caused by the discharge operation of the ink jet head 2 can be suppressed.

The structure of the liquid circulation device described above according to the embodiment is not limited. For example, if the liquid can be replenished to the liquid chamber and circulated, the liquid chamber and the liquid discharge section may not be formed integrally. Further, the liquid circulation device can also discharge liquid except the ink. A liquid discharge device that discharges the liquid except the ink may be, for example, a device for discharging the liquid containing conductive particles for forming wiring patterns of a printed wiring substrate.

The ink jet head 2 generates the change of the pressure in the ink in the ink pressure chamber 25; however, the structure thereof is not limited. The ink jet head may be a structure for discharging the ink droplet through the deformation of the vibration plate with, for example, static electricity or a structure for discharging the ink droplet from the nozzle with the use of thermal energy such as a heater.

The arrangement and the position of the ink cartridge 51 are not limited. For example, in a case in which the ink cartridge 51 is arranged at a position higher than the ink circulation device 3, the head pressure of the ink in the ink cartridge 51 becomes higher than the setting pressure of the collection chamber 32. In a case in which the ink cartridge 51 is arranged at a position higher than the ink circulation device 3, the ink can be supplied from the ink cartridge 51 to the supply chamber 31 by opening and closing a solenoid valve with the use of water head difference. Further, the ink cartridge 51 is also possible to connect with the ink collection chamber 32 other than the ink supply chamber 31. In this case, the liquid circulates from the ink cartridge 51 to the circulation pump 35, the supply chamber 31, the ink jet head and the collection chamber 32 in order.

Further, the structures of the pressure adjustment mechanisms 47 and 48 are not limited to the foregoing piston mechanism, and may be, for example, a tube pump or a bellows pump, and in this case, the pressure adjustment mechanism may increase or decrease the gas in the liquid chamber to pressurize or decompress the liquid chamber.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A liquid circulation device, comprising:

a liquid chamber configured to be connected with a liquid discharge section that discharges liquid and be capable of holding the liquid;

a circulation section configured to circulate the liquid in a flow path containing the liquid chamber and the liquid discharge section;

a liquid replenishment section configured to replenish the liquid to the liquid chamber;

a gas control section configured to be capable of pressurizing or decompressing the liquid chamber; and a control section configured to replenish liquid through the liquid replenishment section in a case in which pressure of the liquid discharge section is in a predetermined reference range and lower than a predetermined threshold value, pressurize the liquid discharge section by pressurizing the liquid chamber through the gas control section in a case in which the pressure is lower than the reference range and decompress the liquid discharge section by decompressing the liquid chamber through the gas control section in a case in which the pressure is higher than the reference range.

2. The liquid circulation device according to claim 1, further comprising a pressure detection section configured to detect the pressure of the liquid chamber, wherein the control section detects the pressure of the liquid discharge section according to the pressure of the detected liquid chamber; and the threshold value is the minimum value of a large amount of past pressure data in the printing stop state.

3. The liquid circulation device according to claim 1, wherein the speed of replenishment or the amount of replenishment is increased gradually when the liquid is replenished.

4. The liquid circulation device according to claim 2, wherein the speed of replenishment or the amount of replenishment is increased gradually when the liquid is replenished.

5. A liquid discharge device, comprising:

the liquid circulation device according to claim 1;

a liquid discharge section configured to include a nozzle for discharging liquid; and a conveyance section configured to convey an image receiving medium to a position at which the liquid is discharged from the nozzle.

6. A control method for a liquid discharge device, including:

circulating liquid in a flow path that contains a liquid discharge section for discharging the liquid and a liquid chamber connected with the liquid discharge section and capable of holding the liquid;

replenishing the liquid through a liquid replenishment section in a case in which pressure of the liquid discharge section is in a predetermined reference range and lower than a predetermined threshold value;

pressurizing the liquid discharge section by pressurizing the liquid chamber through a gas control section in a case in which the pressure is lower than the reference range; and decompressing the liquid discharge section by decompressing the liquid chamber through the gas control section in a case in which the pressure is higher than the reference range.

* * * * *